United States Patent [19]

Koszytorz

[11] 4,422,712

[45] Dec. 27, 1983

[54] HOUSED CONTACT ARRANGEMENT FOR A TUBULAR LAMP

[75] Inventor: Günther Koszytorz, Penzberg, Fed. Rep. of Germany

[73] Assignee: Siemens Aktiengesellschaft, Munich, Fed. Rep. of Germany

[21] Appl. No.: 312,156

[22] Filed: Oct. 16, 1981

[30] Foreign Application Priority Data

Oct. 28, 1980 [DE] Fed. Rep. of Germany ..... 3040538

[51] Int. Cl.[3] ..... H01R 13/187

[52] U.S. Cl. ..... 339/255 R; 339/50 R; 339/56

[58] Field of Search ..... 339/50 R, 52 R, 52 S, 339/54, 56, 75 R, 255 R, 255 P

[56] References Cited

U.S. PATENT DOCUMENTS

| | | | |
|---|---|---|---|
| 3,760,341 | 9/1973 | Grad | 339/272 R |
| 3,906,217 | 9/1975 | Lackore | 339/50 R |

FOREIGN PATENT DOCUMENTS

| | | | |
|---|---|---|---|
| 961732 | 3/1957 | Fed. Rep. of Germany | 339/50 R |
| 1665922 | 2/1971 | Fed. Rep. of Germany | 339/255 P |
| 21031 | 4/1961 | German Democratic Rep. | 339/255 P |

*Primary Examiner*—John McQuade
*Attorney, Agent, or Firm*—Kenyon & Kenyon

[57] ABSTRACT

A contact arrangement for a tubular lamp which is arranged in a housing and is provided at each end with a spherical or cylindrical lamp terminal. A contact piece having a substantially semicylindrical recess is arranged in the housing for receiving the lamp contact terminal. A pressure plate is movably connected at one end thereof to a support block. A further end of the pressure plate rests upon the lamp contact terminal. The housing is provided with a cover which contains a resilient spring. When the housing cover is in place, the resilient spring exerts a force upon the pressure plate which holds the lamp contact terminal in place within the recess of the contact piece. In this manner, the lamp can be removed and replaced without exerting mechanical stress in the axial or radial directions.

4 Claims, 6 Drawing Figures

HOUSED CONTACT ARRANGEMENT FOR A TUBULAR LAMP

BACKGROUND OF THE INVENTION

This invention relates generally to contact arrangements, and more particularly, to a contact arrangement for a tubular lamp which is arranged in a housing and is provided with spherical or cylindrical contact members at both ends thereof.

Krypton lamps of the type used in laser technology are generally constructed with spherical or cylindrical contact members at each end. In known contact arrangements, the contact device is usually formed of resilient contact elements which enclose the contact members of the lamp. In such known arrangements, the spherical or cylindrical contact members of the lamps must be formed with accurately defined dimensions, thereby presenting difficulties when lamps of other types or manufactured by others are desired to be used. In addition, the known arrangement presents the further problem of requiring a considerable force to either insert or remove a lamp. The application of such a force increases the risk of breaking the lamp. The breakage of a lamp of the type used in a laser technology presents a danger to a person performing the removal or replacement operation in view of the pressurization present therewithin.

It is, therefore, an object of this invention to provide a contacting arrangement of the type which electrically couples to spherical or cylindrical contact members of lamps, wherein contact members of various dimensions can be accommodated in the contacting arrangement.

It is a further object of this invention to provide a contacting arrangement wherein lamps which are electrically coupled thereto can be removed and replaced without the application of undue mechanical stress to the lamp.

SUMMARY OF THE INVENTION

The foregoing and other objects are achieved by this invention which provides a contact arrangement for a tubular lamp which is arranged in a housing. The tubular lamp is provided with a contact terminal at each end thereof, the contact terminals each having spherical or cylindrical configurations. The contact arrangement is provided with a contact piece having a substantially semicylindrical recess for engaging the lamp contact terminal. A pressure plate is pivotally coupled at one end thereof to a support block. The further end of the pressure plate rests upon the lamp contact terminal when it is engaged with the contact piece. The arrangement is further provided with a cover portion which contains a spring which, when the cover portion is in place, exerts a force upon the pressure plate so that it more firmly contacts the lamp contact terminal.

It is an advantage of the inventive arrangement that lamp contact terminals of different diameters can be accommodated with reliable mechanical and electrical engagement. Such lamp contact terminals may have cylindrical or spherical configurations, as desired. It is a further advantage of this invention that, upon removal of the cover portion, the lamp can be easily removed from the housing without the exertion of any mechanical stress.

In one embodiment, the bottom of the semicylindrical recess in the contact piece is advantageously provided with a slot which extends along the longitudinal direction thereof. Such a slot insures good mechanical and electrical contact between the contact piece and a lamp contact terminal which has a smaller diameter than the diameter of the semicylindrical recess. Thus, a relatively small lamp contact terminal will firmly engage the connecting piece along at least two contact lines, specifically, the edges of the slot. In a further embodiment, the support block can be formed integrally as an extension of a connecting pin which extends outward of the housing. The support block is connected to the contact piece by means of screws so as to form an electrically conductive union. In one particularly advantageous embodiment, the pressure plate is provided with a T-shaped portion which lies within a corresponding recess in the support block. The T-shaped portion is pivotally retained in the support block by the heads of the screws which are used to couple the support block to the contact piece. Such a pivotal coupling permits the pressure plate to be retained in position over the lamp contact terminal in a manner which permits it to be moved away to facilitate removal of the lamp. The pressure plate can be removed by removing the screws which fasten the support block to the contact piece.

BRIEF DESCRIPTION OF THE DRAWINGS

Comprehension of the invention is facilitated by reading the following detailed description in conjunction with the annexed drawings, in which.

DETAILED DESCRIPTION

Figure 2:
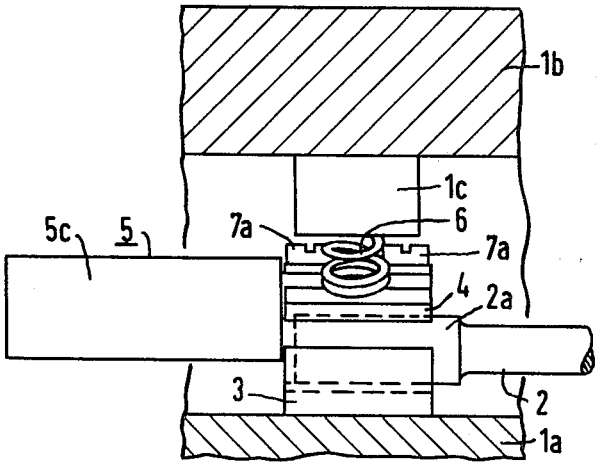
FIG. 2 is a lateral cross-sectional view of the embodiment of FIG. 1.
Figure 1:
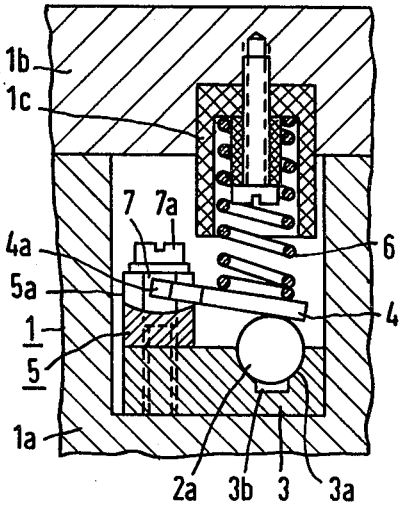
FIG. 1 is a cross-sectional view of a contact arrangement constructed in accordance with the principles of this invention.

FIGS.1 and 2 show respective transverse and longitudinal cross-sectional views of a contact arrangement constructed in accordance with the principles of this invention. A housing 1 which may, for example, be the housing of a laser (not shown), contains a tubular lamp 2 which contains a lamp contact terminal 2*a* at each end. Housing 1 is closed by a cover 1*b* which, in laser embodiments of the invention, may be filled with cooling water. Each lamp contact terminal 2*a* (only one of which is shown) lies in substantially hollow cylindrical recess 3*a* of a plate-shaped contact piece 3.

Figure 3:
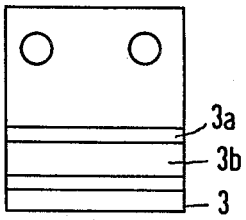
FIG. 3 is an elevated plan view of the contact piece.

FIG. 3 shows an elevated top plan view of plate-shaped contact piece 3. As shown in FIGS. 1 and 2, lamp contact terminal 2*a* is firmly engaged in a cylindrical recess 3*a* of contact piece 3 by a force which is applied by a pressure plate 4. Pressure plate 4 rests at one end thereof upon an edge of a support block 5*a* which will be described hereinbelow with respect to FIG. 4. The other end of pressure plate 4 lies firmly against lamp contact terminal 2*a* by operation of a coil spring 6. As shown, coil spring 6 is retained in cover 1*b* by a mounting arrangement 1*c* which, when cover 1*b* is in place, holds coil spring 6 so that it applies a force to pressure plate 4 at a region between support block 5*a* and lamp contact terminal 2*a*.

Figure 4:
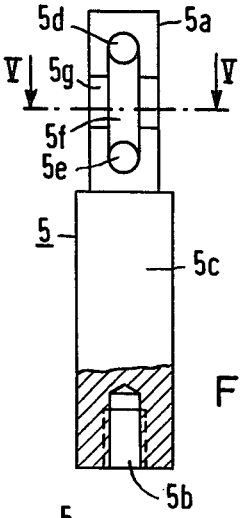
FIG 4 is a partially fragmented elevated plan view of a support block and an integrally formed contact pin.
Figure 5:
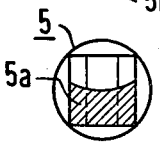
FIG. 5 is a cross-sectional view of the support block and integrally formed contact pin taken along line V—V in FIG. 4.

FIG. 4 shows a top view of support block 5*a*, and FIG. 5 shows a cross-sectional view of support block 5*a*. In this embodiment support block 5*a* is formed as a continuation of contact pin 5*c* which extends out of housing 1. Contact pin 5*c* is provided with a blind tapped hole 5*b* at the end which protrudes from housing 1 so as to permit an external connection thereto. An assembly 5 has a round cross-section in region 5*c* which extends outward of housing 1 so as to simplify the construction of a seal (not shown) at the point where contact pin 5*c* penetrates through housing 1. However, support block 5*a* has a square cross-section and is provided with two holes 5*d* and 5*e* through which a pair of screws 7 are passed for coupling the support block to the contact piece. A slot 5*f* is milled-in between holes 5*d* and 5*e*. A further slot 5*g*, which is arranged transverse to slot 5*f*, is inwardly rounded, as shown in the cross-sectional view of FIG. 5.

Figure 6:
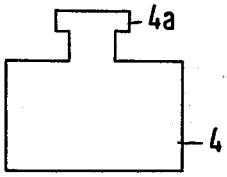
FIG. 6 is an elevated plan view of a pressure plate.

FIG. 6 shows a plan view of pressure plate 4, which, in this embodiment, is provided with a T-shaped extension 4*a*T-shaped extension 4*a* is arranged to lie in the recess which is formed by the intersection of slots 5*f* and 5*g*. Pressure plate 4 is pivotally coupled to support block 5*a* by screw heads 7*a* of screws 7, which partially cover the recess. Thus, T-shaped extension 4*a* of pressure plate 4 is retained in slots 5*f* and 5*g* of support block 5*a* in a manner which permits the pressure plate to be freely movable. Pressure plate 4 may be easily replaced upon removal of screws 7.

The inventive contact arrangement permits lamps having contact terminals of different diameters and shapes to be accommodated with good electrical and mechanical coupling. The contact terminals may have spherical or cylindrical configurations. This arrangement always permits at least three line contacts to ensure a good electrical connection with the lamp contact terminal. If the diameter of lamp contact terminal 2*a* is larger than the diameter of semicylindrical recess 3*a* of contact piece 3, then lamp contact terminal 2*a* rests against the edges of recess 3*a*. If, on the other hand, the diameter of lamp contact terminal 2*a* is smaller, contact is made at the edges of slot 3*b*. In either case, contact is also made through pressure plate 4 which, as described, is also electrically coupled to connecting pin 5*c*.

Lamp 2 can be replaced merely by removing cover 1*b* and coil spring 6. Once these are removed, pressure plate 4 can be raised and lamp 2 can be removed out of the contact arrangement without any mechanical stress. When installing the lamp, the lamp is merely inserted so that its lamp contact terminal rests upon the slot of the contact piece, the pressure plate is flipped down and cover 1*b* is closed. In this embodiment, cover 1*b* cannot be closed while pressure plate 4 is flipped up. Once cover 1*b* is properly closed, a reliable electrical contact with lamp 2 is assured.

Although the invention has been described in terms of a specific embodiment for specific applications, persons skilled in the art, in light of this teaching, can generate additional embodiments for additional aplications, without departing from the spirit and scope of the invention. Accordingly, it is to be understood that the drawings and descriptions in this disclosure are proffered merely to illustrate the principles of the invention, and should not be construed to limit the scope thereof.

What is claimed is:

1. A contact arrangement of the type which provides electrical communication with a lamp contact terminal of a tubular lamp which is arranged in a housing, the lamp contact terminal having a selectable one of spherical and cylindrical configurations, the arrangement comprising:

contact means having a substantially semicylindrical recess for engaging the lamp contact terminal;

support block means electrically coupled with said contact means and arranged beside said substantially semicylindrical recess of said contact means, said support block means having a recess therein extending transverse to said substantially semicylindrical recess of said contact means;

pressure plate means having a first portion retained in contact with said recess in said support block means, and a second portion for contacting the lamp contact terminal;

cover means for closing the housing; and resilient spring means mechanically connected to said cover means for applying a force between said cover means and said pressure plate means upon closure of said cover means.

2. The contact arrangement of claim 1 wherein said substantially semicylindrical recess of said contact means is provided at the bottom thereof with a further slot recess which extends parallel to the direction of said substantially semicylindrical recess.

3. The contact arrangement of claim 1 further comprising:

contact pin means extending from said support block means and outward of the housing; and screw means for electrically coupling said support block means to said contact means.

4. The contact arrangement of claim 3 wherein said pressure plate means is provided with a T-shaped portion which lies in a corresponding recess of said support block means, said T-shaped portion of said pressure plate means being retained in said corresponding recess by the screw heads of said screw means which couples said support block means to said contact means.

* * * * *